US011751638B2

(12) United States Patent
Dente

(10) Patent No.: US 11,751,638 B2
(45) Date of Patent: Sep. 12, 2023

(54) HEEL TRACTION DEVICE

(71) Applicant: Dentec Safety Specialists Inc., Newmarket (CA)

(72) Inventor: Claudio Dente, Newmarket (CA)

(73) Assignee: Dentec Safety Specialists Inc., Newmarket, CA (US)

( * ) Notice: Subject to any disclaimer, the term of this patent is extended or adjusted under 35 U.S.C. 154(b) by 0 days.

(21) Appl. No.: 17/389,617

(22) Filed: Jul. 30, 2021

(65) Prior Publication Data

US 2022/0031026 A1 Feb. 3, 2022

(30) Foreign Application Priority Data

Jul. 31, 2020 (CA) ..... CA 3088637

(51) Int. Cl.
*A43C 15/06* (2006.01)
*A43C 15/16* (2006.01)
*A43C 15/04* (2006.01)

(52) U.S. Cl.
CPC ..... *A43C 15/066* (2013.01); *A43C 15/04* (2013.01); *A43C 15/167* (2013.01)

(58) Field of Classification Search
CPC ..... A43C 15/066; A43C 15/04; A43B 3/20
USPC ..... 36/7.2, 7.4, 7.7, 62
See application file for complete search history.

(56) References Cited

U.S. PATENT DOCUMENTS 183,949 A 10/1876 Loewental
1,117,019 A 11/1914 Foltz
1,195,866 A 8/1916 Stephan
1,275,917 A 8/1918 Herman
1,386,028 A 8/1921 Roe
1,437,376 A 11/1922 Young
1,458,497 A 6/1923 Perkins
(Continued)

FOREIGN PATENT DOCUMENTS

CA 1112865 A 11/1981
CA 2355803 A1 2/2002
(Continued)

OTHER PUBLICATIONS

"Devisys Anti-Slip Devices", https://www.devisys.fi/language/en/en/ last accessed Apr. 25, 2022, 9 pages.
(Continued)

*Primary Examiner* — Ted Kavanaugh
(74) *Attorney, Agent, or Firm* — DORSEY & WHITNEY LLP

(57) ABSTRACT

A heel traction device for attachment to a heel of a shoe or a boot comprises a traction platform formed of a flexible rubber material. The traction platform has a first face for contacting a ground surface and a second face for attachment to the heel of the shoe or boot. The traction platform defines a plurality of openings formed therethrough for receiving a traction element in each of said openings. A support band is connected to the traction platform for securing the traction platform to the shoe or a boot. The support band has a rear portion for attachment to a rear portion of the shoe or the boot and two opposing side portions for attachment to side portions of the shoe or the boot. Each of the side portions define a slot formed therethrough for receiving a strap.

16 Claims, 7 Drawing Sheets

(56) References Cited

U.S. PATENT DOCUMENTS

| | | | | |
|---|---|---|---|---|
| 1,493,322 | A * | 5/1924 | Carter | A43C 15/06 36/62 |
| 1,552,946 | A | 9/1925 | Frederick | |
| 1,564,307 | A | 12/1925 | Antonio et al. | |
| 1,596,832 | A | 8/1926 | Heinemann | |
| 1,757,919 | A | 5/1930 | Ostrander | |
| 1,869,988 | A | 8/1932 | Stephen | |
| 2,128,134 | A | 8/1938 | Nicola | |
| 2,166,958 | A | 7/1939 | Lawson | |
| 2,170,691 | A | 8/1939 | Mutter | |
| 2,189,884 | A | 2/1940 | Dow | |
| 2,208,200 | A | 7/1940 | Sloan | |
| 2,296,660 | A | 9/1942 | Bowman | |
| 2,313,316 | A | 3/1943 | Block | |
| 2,366,649 | A | 1/1945 | Priess | |
| 2,422,335 | A | 6/1947 | Maurice | |
| 2,636,175 | A | 4/1953 | Hoffman | |
| 2,658,289 | A | 11/1953 | Schrieber | |
| 2,668,373 | A * | 2/1954 | Russo | A43B 5/18 36/134 |
| 2,836,428 | A | 5/1958 | Hannes | |
| 2,932,096 | A | 4/1960 | Vincenzo | |
| 3,021,617 | A | 2/1962 | Koch | |
| 3,095,657 | A | 7/1963 | Fradette | |
| 3,176,416 | A | 4/1965 | Seegert | |
| 3,214,850 | A | 11/1965 | McNair | |
| 3,229,389 | A | 1/1966 | George | |
| 3,616,552 | A | 11/1971 | Kniffin et al. | |
| 3,713,233 | A | 1/1973 | Hunnicutt | |
| D242,090 | S | 11/1976 | Wilson | |
| 4,005,533 | A | 2/1977 | Anderson et al. | |
| 4,116,462 | A | 9/1978 | Buel | |
| 4,299,037 | A | 11/1981 | Carey | |
| D262,157 | S | 12/1981 | Kinchen et al. | |
| 4,461,100 | A | 7/1984 | Minor et al. | |
| 4,525,939 | A | 7/1985 | Mcneil et al. | |
| D287,660 | S * | 1/1987 | Strickland | D2/915 |
| 4,662,082 | A | 5/1987 | Shabazz | |
| 4,772,041 | A | 9/1988 | Klosterman | |
| D313,111 | S | 12/1990 | McKinstry | |
| D336,559 | S | 6/1993 | Carmichael | |
| 5,315,768 | A | 5/1994 | Pacheco | |
| D352,381 | S | 11/1994 | Rose | |
| 5,463,823 | A | 11/1995 | Bell et al. | |
| 5,485,687 | A | 1/1996 | Rohde | |
| 5,600,901 | A | 2/1997 | Leonor | |
| 5,689,901 | A * | 11/1997 | Bell | A43B 5/18 36/62 |
| 5,694,704 | A | 12/1997 | Kasbrick | |
| 5,813,143 | A | 9/1998 | Bell et al. | |
| 5,836,090 | A | 11/1998 | Smith | |
| 5,857,271 | A | 1/1999 | Pallatin | |
| 5,921,005 | A | 7/1999 | Bell et al. | |
| 5,926,979 | A | 7/1999 | Borel | |
| 5,967,531 | A | 10/1999 | Saillet | |
| 6,099,018 | A | 8/2000 | Maravetz et al. | |
| 6,154,982 | A | 12/2000 | Bell et al. | |
| 6,742,286 | B2 | 6/2004 | Giovale | |
| 6,775,927 | B2 | 8/2004 | Glicksman | |
| 6,836,977 | B2 | 1/2005 | Larson et al. | |
| 6,931,769 | B2 | 8/2005 | Mahoney et al. | |
| 7,089,688 | B2 | 8/2006 | Giovale | |
| 7,555,850 | B2 | 7/2009 | Park | |
| 7,686,321 | B2 | 3/2010 | Cunningham et al. | |
| RE42,965 | E | 11/2011 | Larson et al. | |
| D648,104 | S | 11/2011 | Bolden | |
| 8,371,045 | B2 | 2/2013 | Tambay | |
| RE44,193 | E | 5/2013 | Larson et al. | |
| 9,161,593 | B2 | 10/2015 | Larson et al. | |
| D807,005 | S | 1/2018 | Savio et al. | |
| D831,320 | S | 10/2018 | Savio et al. | |
| D879,443 | S | 3/2020 | Fridgen | |
| D928,490 | S | 8/2021 | Kang | |
| D964,718 | S | 9/2022 | Savio | |
| 11,439,204 | B2 | 9/2022 | Dente | |
| 11,464,277 | B2 | 10/2022 | Nachmani | |
| D971,572 | S | 12/2022 | Nelson | |
| D976,552 | S | 1/2023 | Kang | |
| 2003/0052473 | A1 | 3/2003 | Perkins et al. | |
| 2003/0145489 | A1 | 8/2003 | Major | |
| 2004/0035024 | A1 | 2/2004 | Kao | |
| 2004/0045190 | A1 | 3/2004 | Washburn et al. | |
| 2004/0049943 | A1 | 3/2004 | Glicksman | |
| 2005/0022430 | A1 | 2/2005 | Terry | |
| 2005/0198860 | A1 | 9/2005 | Larson et al. | |
| 2007/0113424 | A1 | 5/2007 | Bell | |
| 2007/0163148 | A1 | 7/2007 | Laporte | |
| 2008/0263903 | A1 | 10/2008 | An | |
| 2009/0049711 | A1 | 2/2009 | Finch | |
| 2010/0088929 | A1 | 4/2010 | Comoli | |
| 2011/0047829 | A1 | 3/2011 | Bell et al. | |
| 2013/0042503 | A1 * | 2/2013 | Larson | A43C 15/066 12/142 T |
| 2016/0366982 | A1 * | 12/2016 | Chaney | A43C 15/061 |
| 2017/0251765 | A1 | 9/2017 | Romeril | |
| 2020/0138147 | A1 | 5/2020 | Fogg et al. | |
| 2021/0401125 | A1 | 12/2021 | Decaire | |
| 2022/0031025 | A1 | 2/2022 | Dente | |
| 2022/0031026 | A1 | 2/2022 | Dente | |

FOREIGN PATENT DOCUMENTS

| | | | |
|---|---|---|---|
| CA | 2555916 | A1 | 9/2005 |
| CA | 2355803 | C | 10/2008 |
| CA | 2555916 | C | 6/2009 |
| CA | 169322 | S | 2/2017 |
| CA | 169323 | S | 2/2017 |
| CA | 2844620 | C | 9/2017 |
| CA | 182847 | S | 9/2019 |
| CA | 197133 | S | 5/2022 |
| CA | 197134 | S | 5/2022 |
| DE | 102008006267 | B3 | 7/2009 |
| KR | 100983316 | B1 | 9/2010 |

OTHER PUBLICATIONS

"K1 Mid-Sole", SureWerx https://icecleats.surewerx.com/s/product/a0K3x00000vpXUdEAM/k1-midsole last accessed Apr. 25, 2022, 3 pages.

"Rip Cleats", https://ripscleats.com/ last accessed Apr. 25, 2022, 4 pages.

Ex Parte Quayle Action for U.S. Appl. No. 29/747,779 dated Aug. 24, 2022.

Ex Parte Quayle Action for U.S. Appl. No. 29/747,786 dated Aug. 24, 2022.

Issue Notification for U.S. Appl. No. 17/230,703 dated Aug. 24, 2022.

Notice of Allowance for U.S. Appl. No. 17/230,703 dated Mar. 24, 2022.

Notice of Allowance for U.S. Appl. No. 17/230,703 dated May 9, 2022.

Notice of Allowance for U.S. Appl. No. 29/747,779 dated Nov. 21, 2023.

Notice of Allowance for U.S. Appl. No. 29/747,786, filed Nov. 21, 2022.

"Devisys Heel Traction Aid, M, Black, PR", https://www.amazon.com/Heel-Traction-Aid-Black-PR/dp/B00HY16NYA, 2017, 5 pages, as filed on Aug. 17, 2022.

"Due North Qwik Grip Mid-Sole", https://www.amazon.com/Due-North-Qwik-Grip/dp/B0876VGMZK?th=1, 2020, 8 pages, as filed on Aug. 18, 2022.

"Heel Traction Aid, PR", https://www.amazon.com/Due-North-HEELTRACTIONAID-Traction-Black/dp/B00APPWGQQ, 2012, 6 pages, as filed on Aug. 17, 2022.

"ICETRED Heel Traction Devices", https://youtube.com/watch?v=JNaZh1i0_SY&list=PLolZolfylOKrmIVJIK4YYldj2QZHv3hvH&t=4s, 2021, 3 pages filed on Aug. 16, 2022.

(56) References Cited

OTHER PUBLICATIONS

"STABILicers Heel Traction Cleats for Job Safety on Snow and Ice", Https:www.amazon.com/STABILicers-STABIL-Traction-Steel-Cleat/dp/B00P1R969I, 2014, 10 pages as filed on Aug. 17, 2022.

* cited by examiner

HEEL TRACTION DEVICE

FIELD OF THE DISCLOSURE

The present disclosure is directed to a heel traction device that provides anti-slip protection to footwear such as shoes and boots.

BACKGROUND AND SUMMARY OF THE DISCLOSURE

Traction devices provide protection against slipping on surfaces having a low co-efficient of kinetic friction such as ice, snow and other wet surfaces. It is often dangerous walking, running and working in environments having snow and ice on the surface especially when the ground or surface has a grade or slope. Such activities can involve carrying heavy objects where one's vision is at least partially obscured.

Traction devices with spikes exist that attach to footwear. However, such existing traction devices are insufficiently flexible to allow the user to walk or run efficiently and comfortably. In addition, this lack of flexibility results in an inefficient contact of the traction spikes to the slippery surface thereby limiting the effectiveness of the traction device. There is therefore a need for a traction device that is flexible, and which permits efficient contact of the bottom surface of the traction device with the ground surface when coupled to a user's footwear.

The present disclosure is directed to a flexible heel traction device which is configured to attach to the heel of an item of footwear such as a shoe or boot. The heel traction device as attached to the heel of a shoe or boot has traction elements which are preferably spikes as part of a spike assembly that engage the ground to provide improved traction. The flexibility of the heel traction device and the inclusion of a separate strap, preferably a Velcro strap, that is preferably received in slots formed in the heel traction device permits the traction elements to contact and grip the ground efficiently in harnessing the user's weight transfer.

According to one aspect of the present disclosure, there is provided a heel traction device for attachment to a heel of a shoe or a boot comprising a traction platform formed of a flexible rubber material. The traction platform has a first face for contacting a ground surface and a second face for attachment to the heel of the shoe or boot. The traction platform defines a plurality of openings formed therethrough for receiving a traction element in each of said openings. The heel traction device also has a support band connected to the traction platform for securing the traction platform to the shoe or a boot. The support band has a rear portion for attachment to a rear portion of the shoe or the boot and two opposing side portions for attachment to side portions of the shoe or the boot. Each of said side portions defining a slot formed therethrough for receiving a strap. The strap that is received in the slots is separate from the support band and is preferably a Velcro strap.

Additional features and advantages of the present invention will become apparent to those skilled in the art upon consideration of the following detailed description of the illustrative embodiments exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION

The embodiments of the invention described herein are not intended to be exhaustive or to limit the invention to precise forms disclosed. Rather, the embodiments elected for description have been chosen to enable one skilled in the art to practice the invention.

Figure 1:
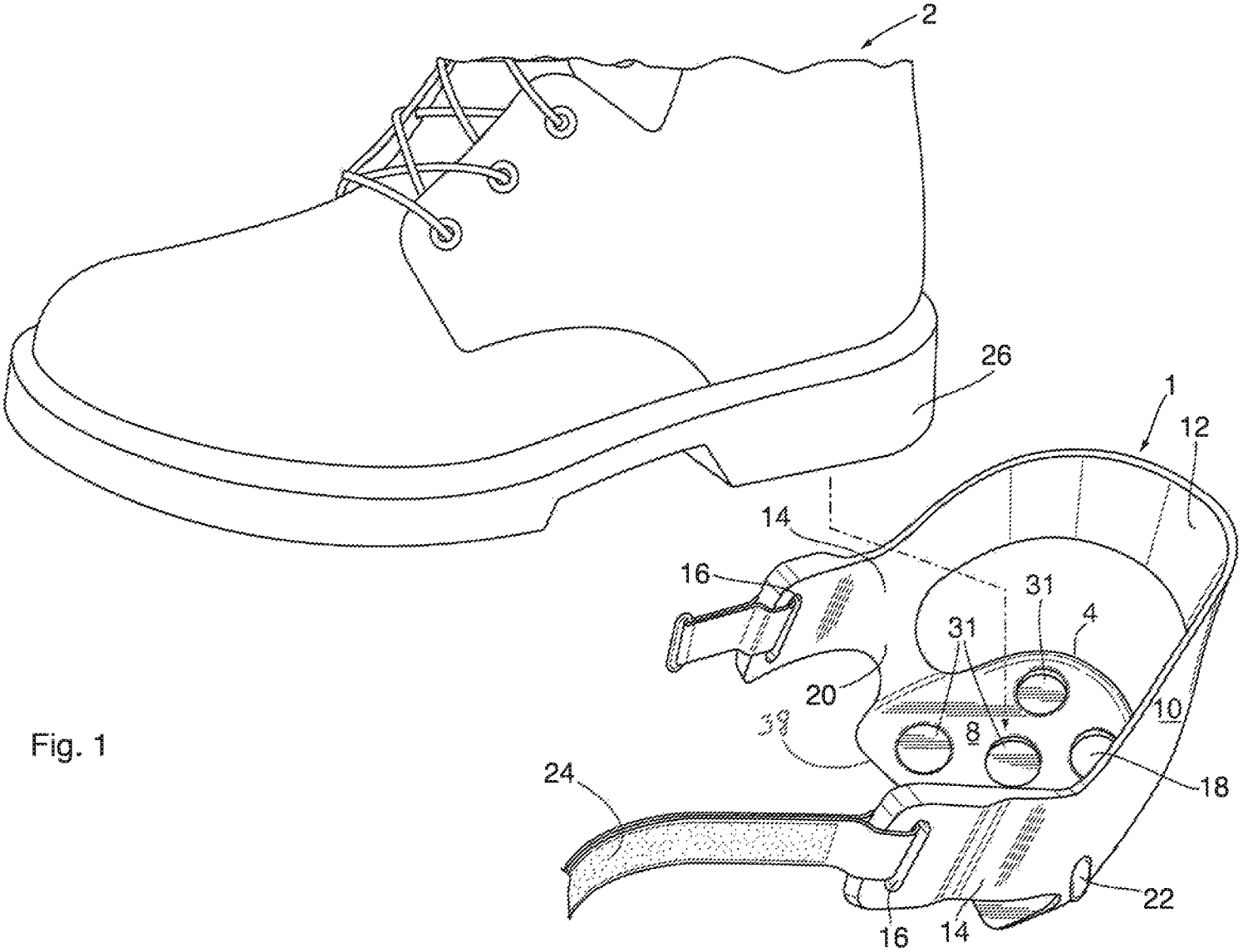
FIG. 1 is a top perspective view of a heel traction device of the present disclosure shown with reference to a boot.
Figure 2:
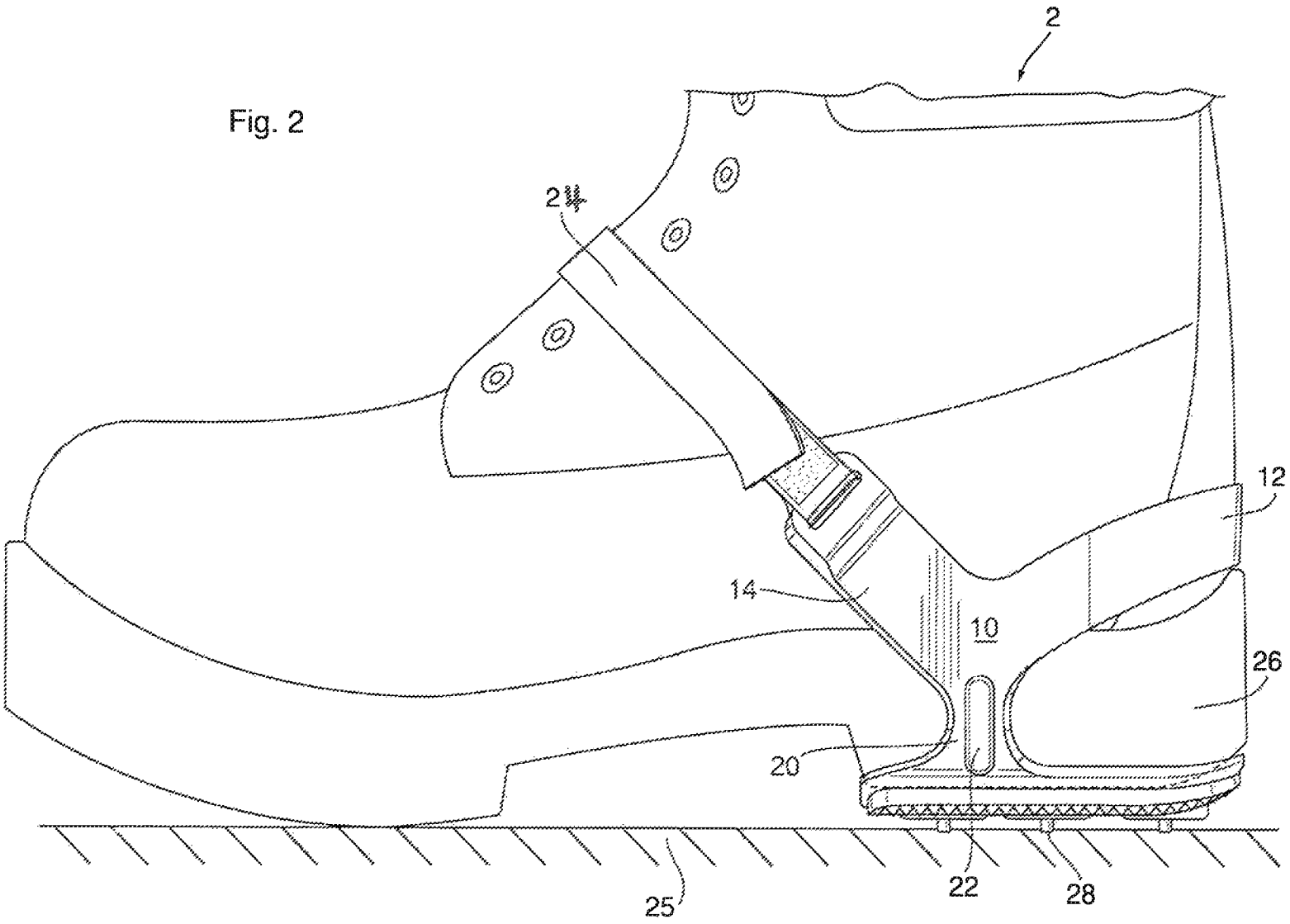
FIG. 2 is a side view of the heel traction device of the present disclosure as attached to a boot.

With reference initially to FIG. 1, an illustrative heel traction device 1 is illustrated with reference to a boot 2 to which the heel traction device 1 is attached at a heel region 26 of the boot 2 as illustrated in FIG. 2.

Figure 4:
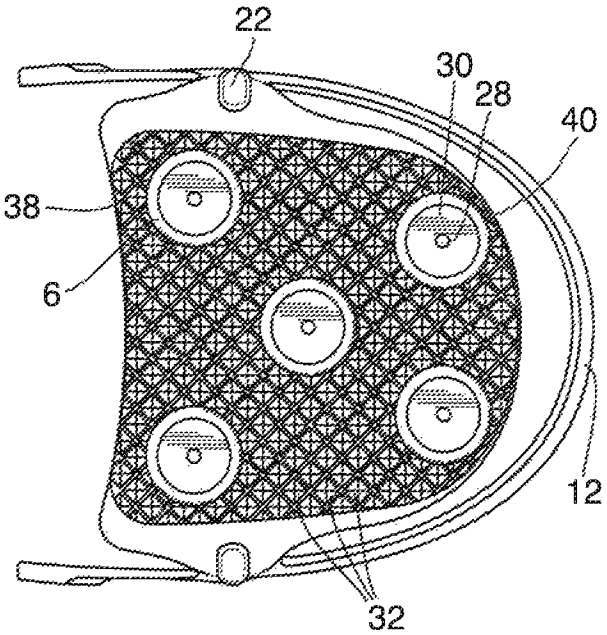
FIG. 4 is a bottom view the heel traction device of the present disclosure.
Figure 3:
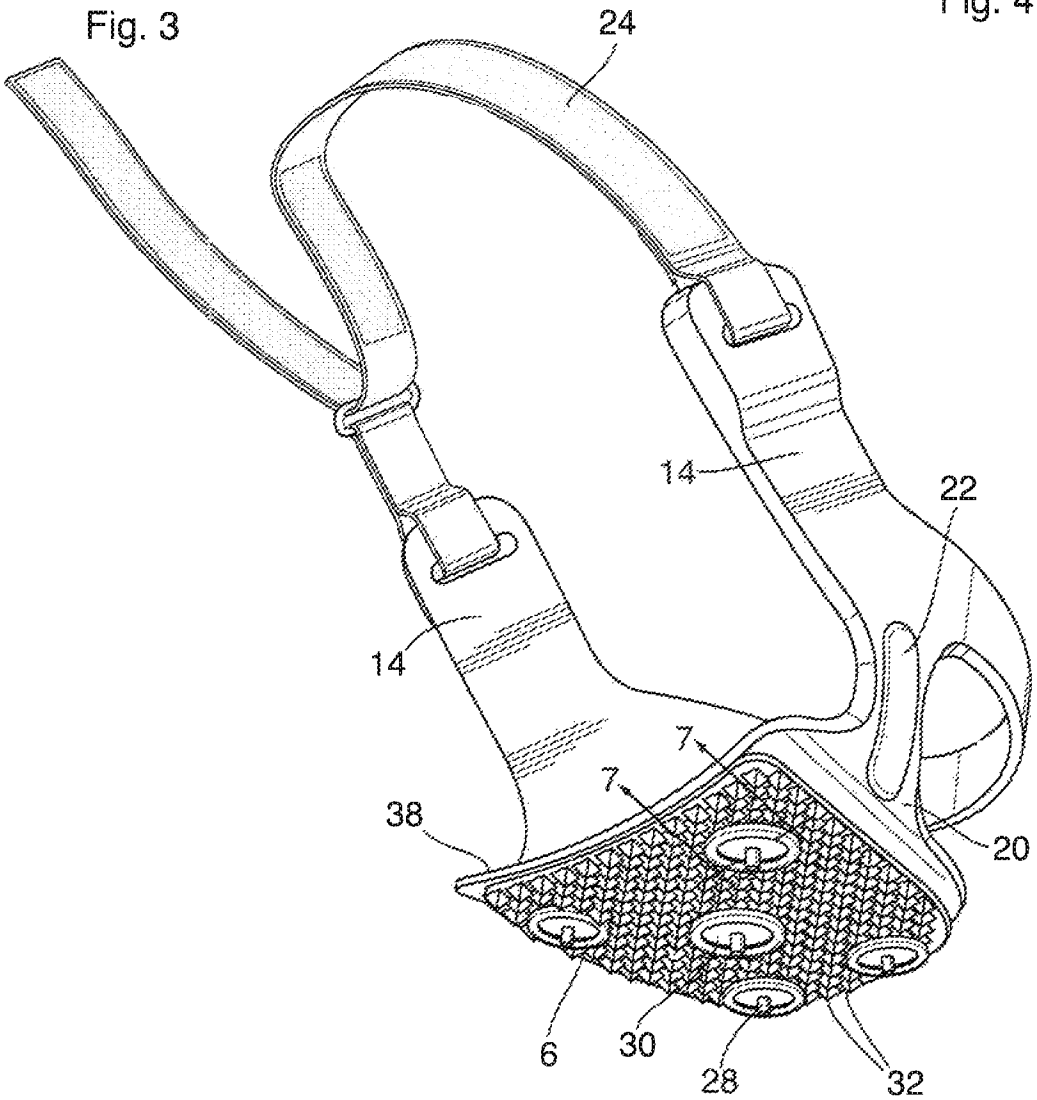
FIG. 3 is a bottom perspective view the heel traction device of the present disclosure.
Figure 5:
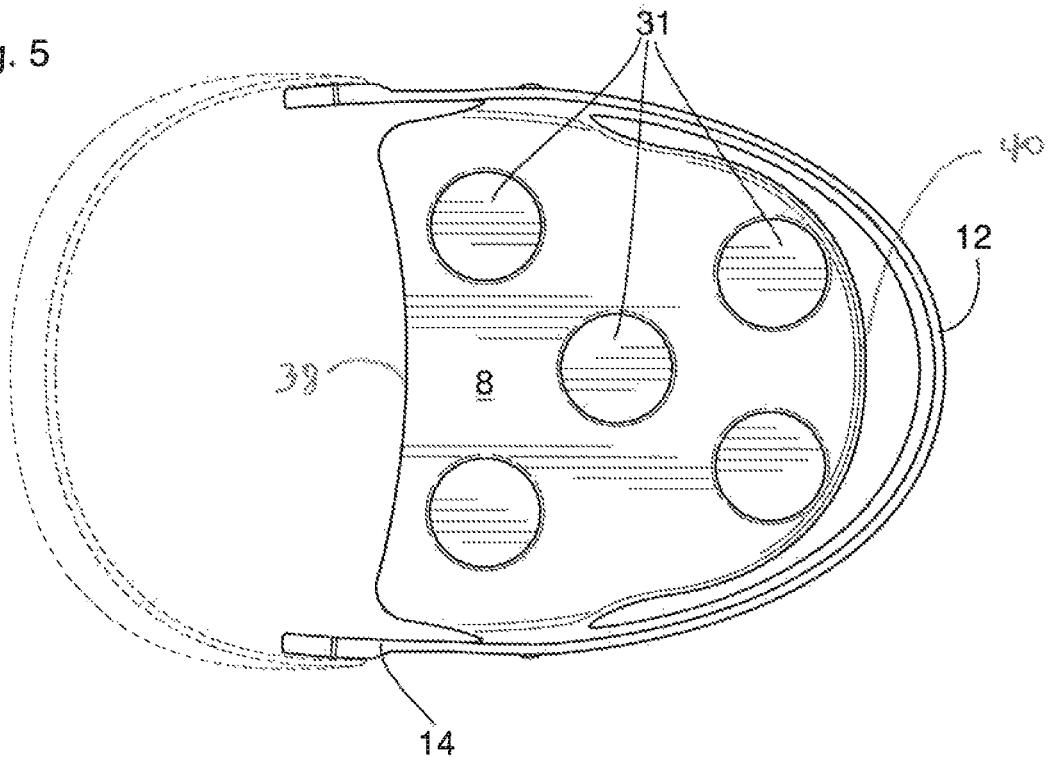
FIG. 5 is a top view of a second face of a traction platform of the heel traction device of the present disclosure.

The heel traction device 1 comprises a traction platform 4 having a first face 6 for contacting a ground surface, as shown in FIGS. 3 and 4, and a second face 8 which is attachable to a bottom surface of boot 2 at the heel region 26, as discussed in more detail below. As shown in FIG. 1, the traction platform 4 is preferably semi-circular in shape to match the contour of the heel of the boot. However, the traction platform 4 is not limited to any particular shape and may have other shapes having different numbers of sides including pentagonal, hexagonal or a square shape. The traction platform 4 may also have a rectangular or a triangular shape in other embodiments.

The heel traction device 1 also comprises a support band 10 connected to the traction platform 4 for securing the traction platform to a shoe or a boot. In the embodiment shown in FIGS. 1-5, the support band 10 is connected to the traction platform 4 by two web members 20. The web members 20 each preferably have a support rib 22 at a central portion thereof. The web members 20 are located close to a front end 38 of the traction platform 4. Preferably, a center of each of the web members 20 is located about 2 cm from the from the front end 38 of the traction platform 4 and about 4.7 cm from a rear end 40 of the traction platform 4. By positioning the web members 20 closer to the front end 38 of the traction platform 4 than to the rear end 40 of the traction platform 4, better placement of the heel of a shoe or boot onto the traction platform 4 is accomplished. This helps the traction platform 4 to sit in a better position when attached to the shoe or boot to ensure more effective surface contact by the spikes 28. The support band 10 has a rear portion 12 for attachment to a rear portion of the shoe or boot and two opposing side portions 14 for attachment to side portions of the shoe or the boot. A slot 16 is formed in each of the side portions 14 for receiving a strap 24. The strap 24 is preferably a Velcro strap (i.e., a hook and loop strap). The strap 24 is separate from the support band 10. As such, the heel traction device 1 may be provided without a strap for later attachment to a strap.

The traction platform 4 and preferably also the support band 10 is constructed of a flexible rubber material. Preferably, the rubber material has the following composition as set out in table 1 below.

TABLE 1

Composition of Rubber Material

| Rubber Composition Component | Content, Wt % |
|---|---|
| Poly(isoprene) | 37 |
| Styrene-butadiene rubber (SBR) | 10 |
| Benzothiazole vulcanizing accelerator | 21 |
| Phenol antioxidant | |
| Quinoline antioxidant | |
| Cyclohexylthiophthalimide | |
| Stearic acid | |
| Mineral oil | |
| Carbon black | 13 |
| Calcium carbonate ($CaCO_3$) | 5 |
| Silicon dioxide ($SiO_2$) | 14 |
| Zinc oxide (ZnO) | |
| Sulfur | |
| Talc | |

The content of the components of the rubber composition was measured by Fourier Transform Infrared Spectrometer.

The hardness of the rubber composition forming the traction platform 4 and the support band 10 is 43.5 on the Shore A hardness scale, as measured by a Shore A Durometer apparatus.

The thickness of the traction platform is preferably about 6.5 mm. The thickness of the support band is preferably about 2.45 mm.

Figure 6:
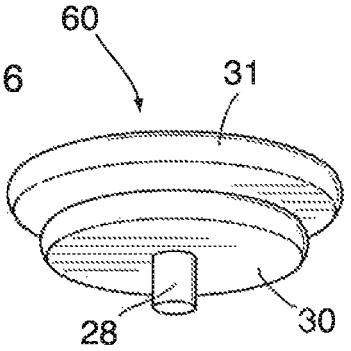
FIG. 6 is a perspective view of a spike assembly of the present disclosure.

As shown in FIG. 1, openings 18 are formed in the second face 8 for receiving a traction element in the form of a spike assembly 60 which includes a spike 28 for gripping a ground surface which may be slippery due to the presence of ice or any other slippery substance. There are a plurality of spike assemblies 60 formed in the traction platform 4 as shown in FIGS. 3 and 4. The openings 18 extend through the first face 6 so that the spikes 28 may contact the ground. As shown in FIG. 6, the spike assembly preferably further includes two interconnected and concentric, flat and circular flanges. A lower flange 30 is connected to and spaced apart from a top flange 31. The lower flange 30 and the top flange 31 are connected by a centrally located post member (not shown) that extends between the lower flange 30 and the top flange 31. Preferably, the lower flange 30, the top flange 31 and the post member are integrally formed and are constructed of plastic. The top flange 31 has a greater circumference than the lower flange 30. The spike 28 is attached to the lower flange 30, as shown in FIG. 6. The spike assembly is received in the opening 18 such that when the spike assembly is inserted into the opening, the top flange 31 engages a top surface of the opening 18 that forms an indentation in the second face 8. The lower flange 30 engages a lower surface of opening 18 which forms an indent in the first face 6. This arrangement allows the spike assembly to be securely received in opening 18. The spike assemblies are preferably replaceable in the openings 18. The spikes 28 are preferably comprised of 15% by weight of cobalt, 75% by weight of tungsten and 10% by weight of carbon.

Figure 7:
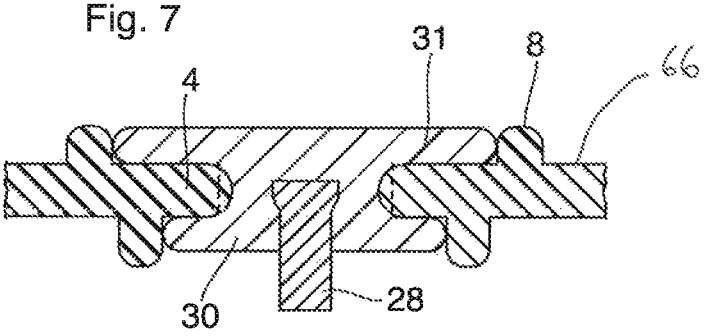
FIG. 7 is cross-sectional view taken along the lines 7-7 of FIG. 3.
Figure 8:
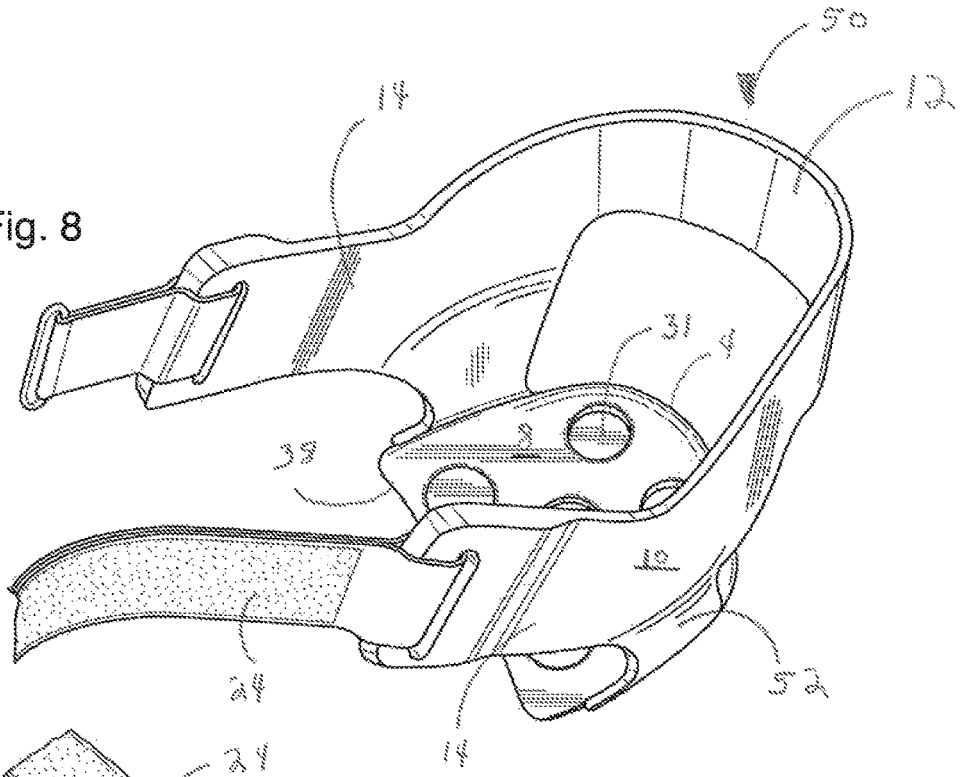
FIG. 8 is a top perspective view of an alternate embodiment of the heel traction device of the present disclosure.
Figure 9:
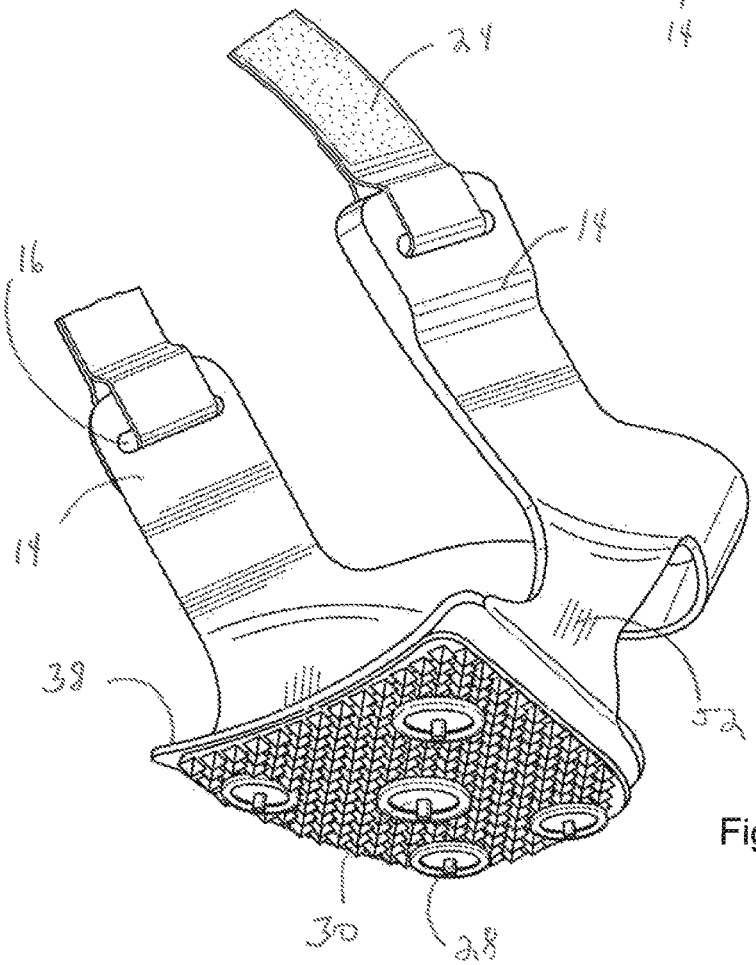
FIG. 9 is a bottom perspective view of the alternate embodiment of the heel traction device of the present disclosure.

As shown in FIG. 7, the diameter of the lower flange is preferably about 11.4 mm and the diameter of the top flange is preferably about 15.6 mm. The thickness of a portion 66 of the traction platform 4 immediately adjacent to the openings 18 is preferably about 1.7 mm.

As shown in FIGS. 3, 4, 9 and 11 the first face 6 preferably has gripping elements 32 formed thereon to provide additional traction. The gripping elements can be arranged in various different patterns in alternate embodiments.

Figure 10:
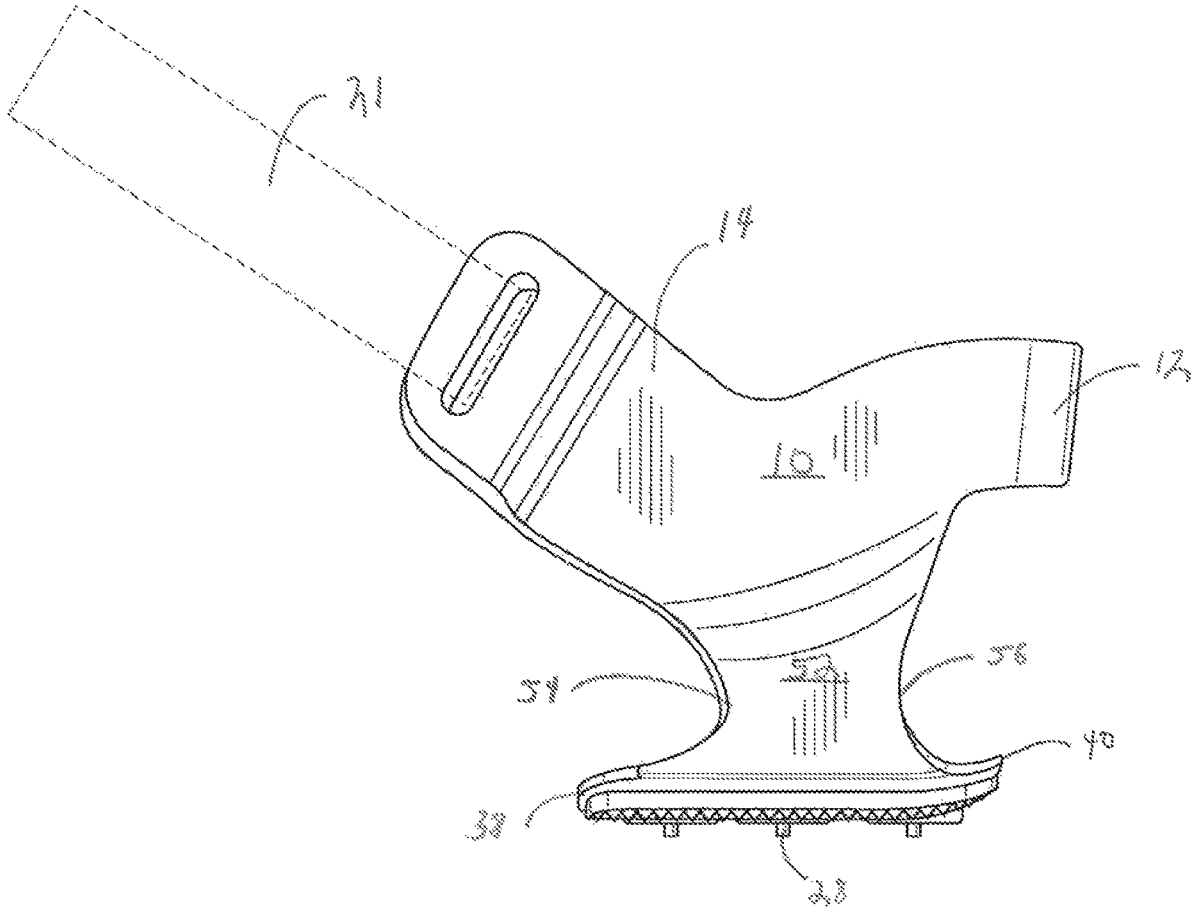
FIG. 10 is a side view of the alternate embodiment of the heel traction device of the present disclosure.
Figure 11:
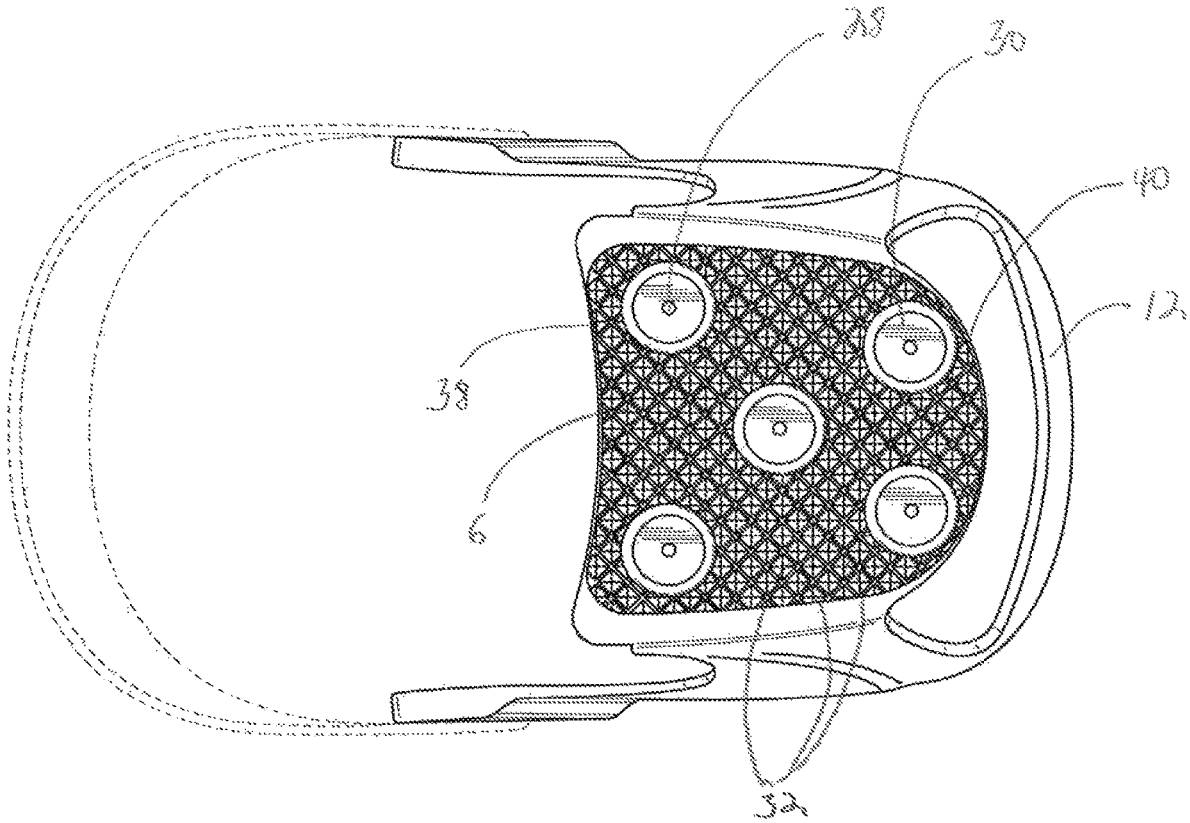
FIG. 11 is a bottom view of the alternate embodiment of the heel traction device of the present disclosure.

An alternate embodiment 50 of the heel traction device is shown in FIGS. 8 to 11. The alternate embodiment has two web members 52 that connect the support band 10 to the traction platform 4. The web members 52 are located centrally between the front end 38 of the traction platform and the rear end 40 of the traction platform 4. As shown in FIG. 10, each of the web members 52 has a curved portion 54 at a front of the web member 52 and a second curved portion 56 at a rear of the web member 52. The web members 52 each preferably have a width of about 2.8 cm between the curved portion 54 and the second curved portion 56. The web members 52 preferably each have a thickness of about 2 mm. The positioning of the web members 52 between the front end 38 of the traction platform and the rear end 40 of the traction platform 4 combined with the width, thickness and composition of the web members 52 assists in maintaining the orientation of the traction platform 4 relative to the rear portion 12 of the support band 10 and to the shoe or boot to which the heel traction device 50 is attached.

The alternate embodiment 50 of the heel traction platform is composed of the rubber material described above and summarized in table 1.

The heel traction device is constructed according to methods known in the art such as injection molding involving the injection of a hot polymeric material into a cold mold. Preferably, the heel traction device is constructed using compression molding machines. The raw material is weighed and cut to size to fit into the mold. The temperature is carefully monitored to be consistent with the cycle time required to flow the material to all portions of the mold. Once the cycle is complete, the operator uses compressed air to cleanly lift the molded part out of the tooling by hand.

Injection molding techniques that extrude material over an existing core plate in the mold to provide a unitary construction may also be employed.

In operation, each of the heel traction device 1 and the alternate embodiment 50 may be attached to footwear such as the boot 2 at the heel 26 as shown in FIG. 2 by securing the heel traction device 1 or the alternate embodiment 50 to the boot 2 by tightening the strap 24. The flexibility of the traction platform 4 in combination with a separate strap preferably made of Velcro provides sufficient flexibility such that that the heel traction device 1 and the alternate embodiment 50 fit comfortably and securely to the heel of a shoe or boot. This ensures that first face 6 makes direct contact with a ground surface 25 at an efficient contact angle for gripping the slippery surface. The spikes 28 engage the ground directly at a contact angle of 90 degrees to the surface thereby imparting an efficient contact force of the spikes to the ground upon application of the weight of the user in order to provide an effective grip to minimize the risk of the user slipping and falling.

Although the invention has been described in detail with reference to certain preferred embodiments, variations and modifications exist within the spirit and scope of the invention as described and defined in the following claims.

The invention claimed is:

1. A heel traction device for attachment to a heel of a shoe or a boot, the heel traction device comprising:

a traction platform formed of a flexible rubber material, the traction platform having a first face for contacting a ground surface and a second face for attachment to the heel of the shoe or boot, the traction platform defining a plurality of openings formed therethrough configured to receive a traction element in each of said plurality of openings; and a support band connected to the traction platform for securing the traction platform to the shoe or the boot, the support band having a rear portion for attachment to a rear portion of the shoe or the boot and two opposing side portions for attachment to side portions of the shoe or the boot, each of said side portions defining a slot formed therethrough for receiving a strap, the support band further including two opposing web members connecting the support band to the traction platform, wherein each of the two opposing web members are spaced from, and located centrally between, a front end of the traction platform and a rear end of the traction platform, and each of the two opposing web members have a width sufficient to maintain the orientation of the traction platform relative to the rear portion of the support band and to the shoe or the boot.

2. The heel traction device of claim 1 wherein openings are further configured to receive the traction elements that include spikes attached to a flange wherein a separate flange accommodating a spike is received in each of said openings.

3. The heel traction device of claim 1, further comprising a strap received in the slots formed in the support band.

4. The heel traction device of claim 3 wherein the strap is a hook and loop strap.

5. The heel traction device of claim 1 wherein the traction platform is comprised of a rubber composition comprising of about 37% by weight of polyisoprene, and about 10% by weight of styrene-butadiene rubber (SBR).

6. The heel traction device of claim 5 wherein the rubber composition is further comprised of about 13% by weight of carbon black and about 5% by weight of calcium carbonate.

7. The heel traction device of claim 6 wherein the rubber composition is further comprised of benzothiazole vulcanizing accelerator, phenol antioxidant, quinoline antioxidant, cyclohexylthiophthalimide, stearic acid and mineral oil, wherein the combination of the benzothiazole vulcanizing accelerator, phenol antioxidant, quinoline antioxidant, cyclohexylthiophthalimide, stearic acid and mineral oil constitutes about 21% by weight of the rubber composition.

8. The heel traction device of claim 7 wherein the rubber composition is further comprised of silicon dioxide, zinc oxide, sulfur and talc, wherein the combination of the silicon dioxide, zinc oxide, sulfur and talc constitutes about 14% by weight of the rubber composition.

9. The heel traction device claim 5 wherein the rubber composition has a hardness of 43.5 on the Shore A hardness scale.

10. The heel traction device of claim 1 wherein the traction platform is semi-circular in shape.

11. The heel traction device of claim 1 wherein a thickness of the traction platform is about 6.5 mm.

12. The heel traction device of claim 1 wherein a thickness of the support band is about 2.45 mm.

13. The heel traction device of claim 1 wherein the first face includes a plurality of gripping elements.

14. The heel traction device of claim 1 wherein the web members each include a support rib.

15. The heel traction device of claim 1 wherein the web members have a thickness of about 2 mm.

16. The heel traction device of claim 1 wherein the web members have opposing peripheral curved portions, the web members having a width of about 2.8 cm between the peripheral curved portions.

* * * * *